US007959004B2

(12) United States Patent
Tsao

(10) Patent No.: US 7,959,004 B2
(45) Date of Patent: Jun. 14, 2011

(54) SAFE PACKAGING CONTAINER

(76) Inventor: Steven Tsao, Diamond Bar, CA (US)

( * ) Notice: Subject to any disclaimer, the term of this patent is extended or adjusted under 35 U.S.C. 154(b) by 251 days.

(21) Appl. No.: 12/212,541

(22) Filed: Sep. 17, 2008

(65) Prior Publication Data

US 2010/0065459 A1 Mar. 18, 2010

(51) Int. Cl.
*B65D 83/04* (2006.01)

(52) U.S. Cl. ..... 206/531; 206/1.5; 206/539

(58) Field of Classification Search ..... 206/528, 206/530, 531, 534, 534.1, 534.2, 538, 539, 206/1.5; 220/324, 326, 345.3, 4.23
See application file for complete search history.

(56) References Cited

U.S. PATENT DOCUMENTS 3,394,838 A * 7/1968 Larkin ..... 220/326
4,120,400 A * 10/1978 Kotyuk ..... 206/528
4,384,649 A * 5/1983 Brodsky ..... 206/538
5,244,091 A * 9/1993 Tannenbaum ..... 206/531
5,437,371 A * 8/1995 Lataix ..... 206/539
5,549,204 A * 8/1996 Toren ..... 206/539
5,769,234 A * 6/1998 Gueret ..... 206/581
7,455,012 B2 * 11/2008 Murphy ..... 101/327
2006/0102512 A1 * 5/2006 Lo Duca ..... 206/531
2007/0227931 A1 * 10/2007 Shane ..... 206/528

* cited by examiner

*Primary Examiner* — Luan K Bui
(74) *Attorney, Agent, or Firm* — Chun-Ming Shih

(57) ABSTRACT

A safe packaging container made to be folded or rolled has the opening surface thereof hidden by use of a cooperative fixing element, so that the contents loaded in the packing container are protected safely from being destroyed and that the packing container is not easy to open. The structure design can be applied to improve the conventional blister-type packaging container, which has the disadvantage of being easy to open and therefore poses a risk of accidental child ingestion. Moreover, the folded or rolled safe packaging container has a reduced volume and weight and therefore is more convenient for transporting.

1 Claim, 10 Drawing Sheets

SAFE PACKAGING CONTAINER

BACKGROUND OF THE INVENTION

1. Field of the Invention

The present invention relates to a safe packaging container that has an improved blister-type package which can solve the disadvantage of conventional blister-type package and is easy to open so as to promote the package safety.

2. Descriptions of the Related Art

Generally, oral drugs are packaged in bottles or blister-type containers for storage. Conventional bottled drug containers were easy to store but lacked sufficient safety. In the case where a child reaches a drug bottle, the child may twist the cap off of the bottle easily and ingest the drugs. As a result, the child will suffer great injury. The occurrence of children's accidental ingestion leads to an improvement with respect to the manner of opening a drug bottle. A safe drug packing design, so-called "safety drug bottle," has been used widely nowadays. The manner of opening such a safety drug bottle lies in that the cap is to be pressed before twisting so as to reduce the possibility of children's accidental ingestion.

The blister-type package is another present day type of package commonly used for oral drugs. The application of blister-type packages has become very widely used and mature. In additional to drugs and health foods, blister-type packages are widely used for articles such as cell phones, nails, toys and other various daily necessities. A blister-type package essentially consists of a blister sheet and a back film. In the blister sheet, there are disposed multiple recesses for loading the contents. Packaging is done with the back film. The contents do not tend to be destroyed or deformed since they are under the protection provided by the blisters. In use, the quantity of drugs bottle be controlled conveniently because the ratio of one single recess per single content item. Although the blister sheet is very solid, the back film, which is usually made from material such as tin foil and paper, can result in weaker package safety. Such material tends to break; if the contents are drugs or other articles that should not be ingested, they can also cause danger to a child that reaches them. Moreover, additional protection is required during transport to keep the back film from breaking that result in heavier associated weight of the packaging.

Since the conventional packaging has the drawbacks described above, an improvement is urgently required.

In view of the above difficulties associated with the conventional packaging, the present inventor, through long-term study and practice, has set about the work of improvement and innovation that provides the present safe packaging container.

SUMMARY OF THE INVENTION

The primary aspect of this invention is to provide a safe packaging container having an improved blister type to solve the disadvantage of conventional blister-type package, which is easy to open and promotes package safety.

Another aspect of this invention is to provide a safe packaging container made to be folded or rolled so as to have a reduced volume and weight while also maintaining safety and convenience when transported.

Another aspect of this invention is to provide a safe packaging container having wide use applications, low cost, simple fabrication and ease of use.

A safe packaging container that may fulfill the above requirements comprises a blister sheet, which has a plurality of recesses concavely disposed thereon each for loading a content, and a back film, which is bounded on the planar surface of the blister sheet so as to cover the contents loaded in the recesses. The safe packaging container is folded about more than one crease disposed on the blister sheet and on the back film, and then is fixed by a fixing element disposed on the blister sheet so that the back film is hidden by the blister sheet. Alternatively, the blister sheet may be rolled directly after being bound with the back film, and then is fixed by a fixing element disposed thereon so that the back film is hidden by the blister sheet. Alternatively, when the blister sheet and the back film are bound together, an overlaying cover may be disposed so that the overlaying cover may directly cover the planar surface of the blister sheet, and then the blister sheet is fixed by a fixing element disposed thereon so that the back film is hidden by the blister sheet. All the methods described above can be performed to protect the back film from breaking due to external force, so that the contents can be stored safely. Further, the container has a reduced volume and thereby has more convenience when being carried. Furthermore, the container is not easy to open due to the fixing element, so that the danger of children's ingestion can be reduced.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
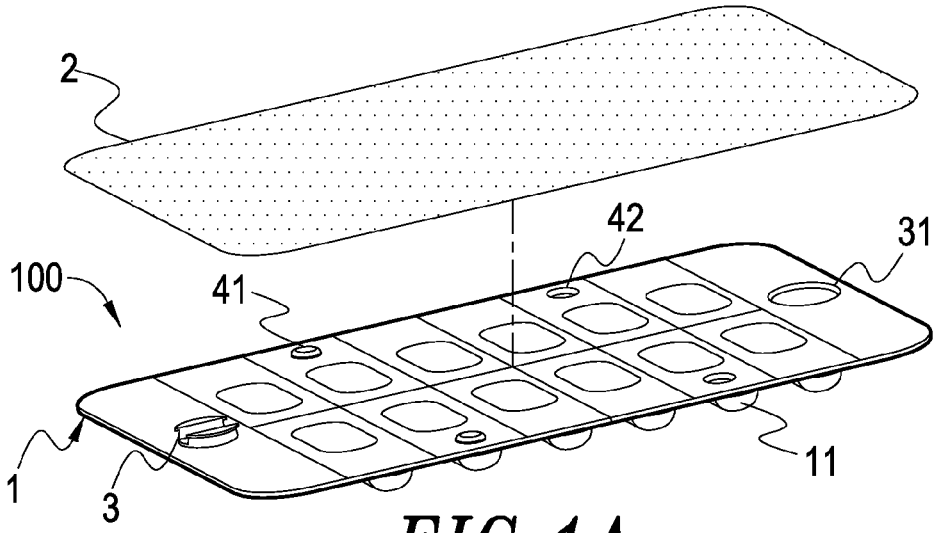
FIG. 1A to FIG. 1C. are views of a first embodiment of the inventive safe packaging container made to be folded.
Figure 1B:
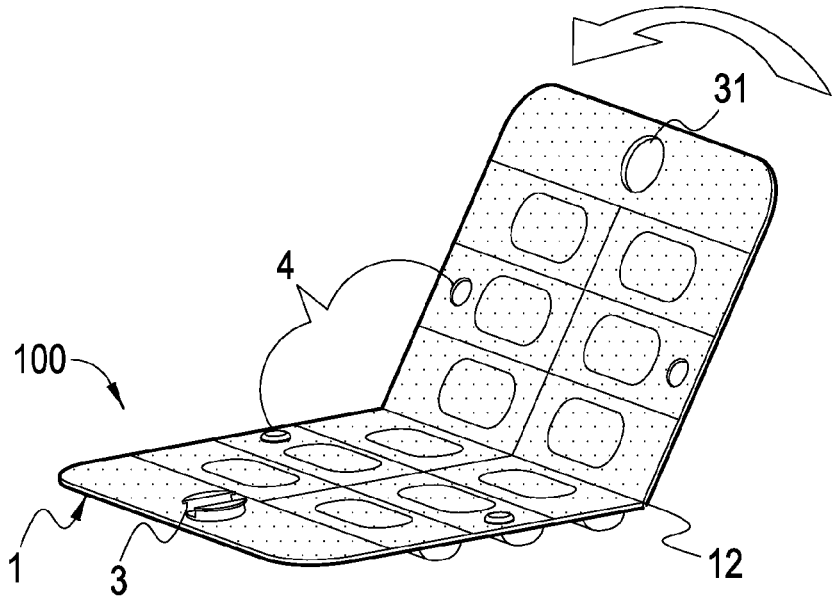
Figure 1C:
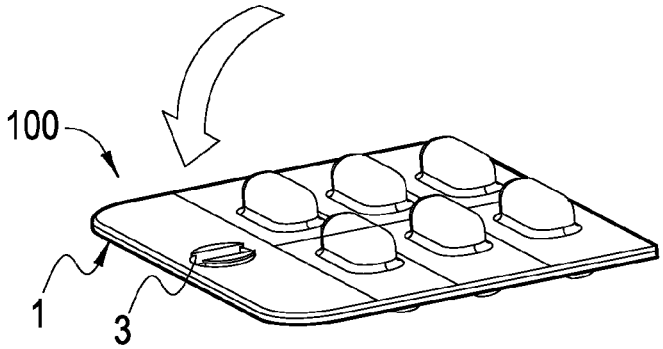

Referring to FIG. 1A to FIG. 1C, views of a first embodiment of the inventive safe packaging container made to be folded are shown. As the inventive safe packaging container 100 is made to be folded, a blister sheet 1 has a plurality of recesses 11 concavely disposed thereon each for loading a content (e.g. tablet, capsule, mercury cell and the like). A back film 2 is bounded to the blister sheet 1 so as to cover the contents loaded in the recesses 11. A crease 12 is disposed on the blister sheet 1 and on the back film 2, and is positioned along the direction in which the blister sheet 1 is folded. A fixing element 3 is disposed at one end of the blister sheet 1. A through-hole 31 is disposed at the other end of the blister sheet 1. An auxiliary fixing element 4 consisting of a button 41 and a concave hole 42 is optionally disposed for strengthening the connection of the folded blister sheet 1. Two buttons 41 and two concave holes 42 are disposed on two edges of the blister sheet 1. In such a structure, the blister sheet 1 is folded about the crease 12 after being bound to the back film 2, so that the back film 2 is hidden by the blister sheet 1. The fixing element 3 disposed at one end of the blister sheet 1 perforates through the through-hole 31 disposed at the other end of the blister sheet 1, so as to lock with the through-hole 31 and therefore to fix the blister sheet 1. Moreover, the buttons 41 and the concave holes 42, disposed on edges of the blister sheet 1, make the edges of the folded packaging container 100 even tighter. This makes sure the safe packaging container 100 is not easy to open due to the fixing element and the danger of children's ingestion is reduced. On the other hand, when the packaging container 100 is carried or moved, the back film 2 is kept from being touched and breaking since the back film 2 is hidden by the blister sheet 1, so that the contents cannot be damaged by external force or be contaminated. Yet, the effectively reduced volume can bring increased convenience when the container 100 is transported.

Figures 2A, 2B, 2C:
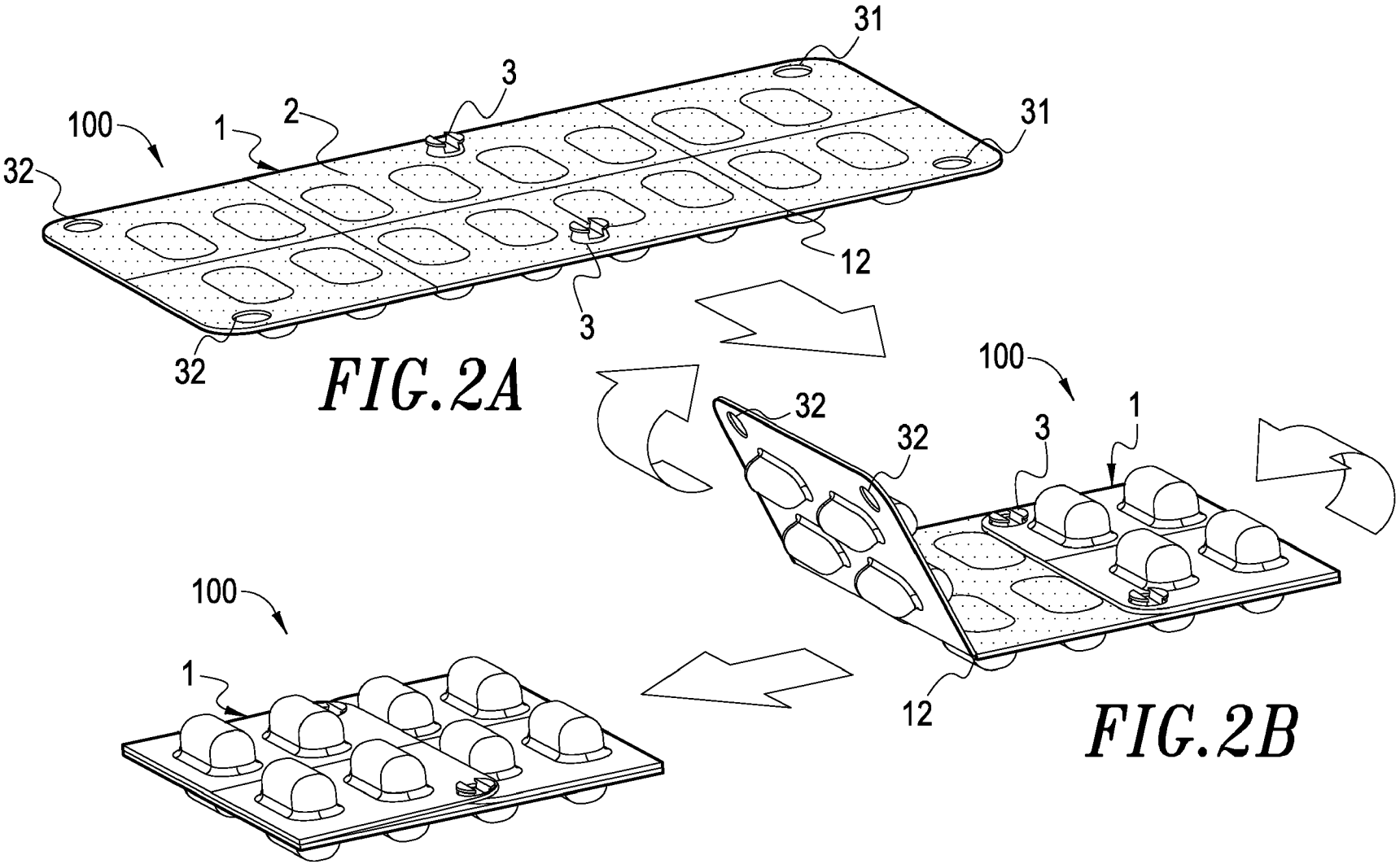
FIG. 2A to FIG. 2C. are views of a second embodiment of the inventive safe packaging container made to be folded.

Referring to FIG. 2A to FIG. 2C, views of a second embodiment of the inventive safe packaging container made to be folded are shown. In the inventive packaging container 100, two creases 12 are disposed on the blister sheet 1 and the back film 2, and two fixing elements 3 are disposed at the centers of two edges of the blister sheet 1 and two through-holes 31 and two through-holes 32 are disposed respectively at two ends of the blister sheet 1. To fold the packaging container 100, one half of the blister sheet 1 is folded about the crease 12 on the corresponding side with the fixing elements 3 perforating through and locking with the through-holes 31. Then, the other half of the blister sheet 1 is folded about the crease 12 on the other side with the fixing elements 3 perforating through and locking with the through-holes 32. The creases 12 as disposed not only make the contents safe due to folding the blister sheet 1, but also further reduce the volume of the packaging container 100 and bring convenience in transporting the packaging container 100.

Figure 3A:
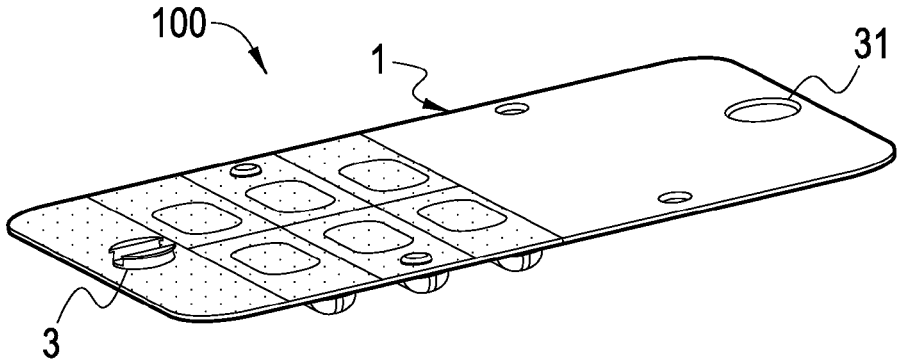
FIG. 3A to FIG. 3C. are views of a third embodiment of the inventive safe packaging container made to be folded.
Figure 3B:
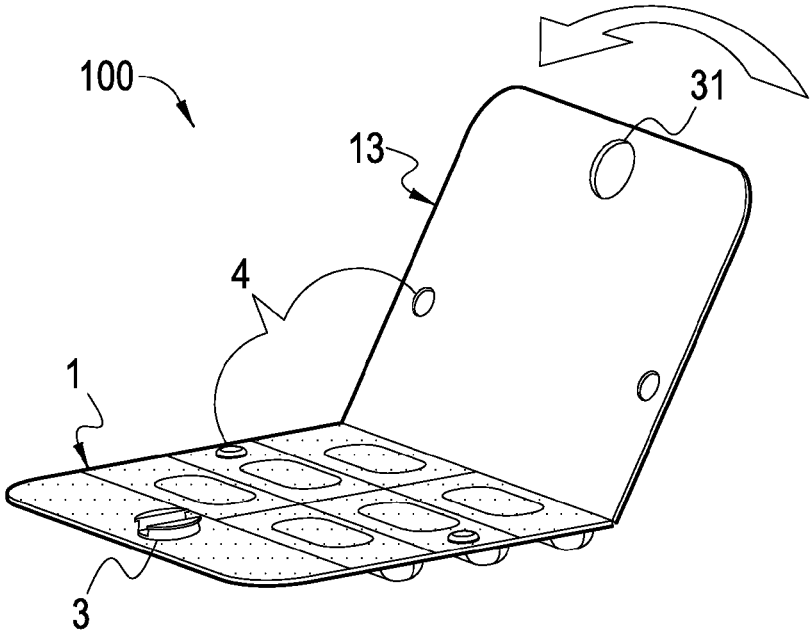
Figure 3C:
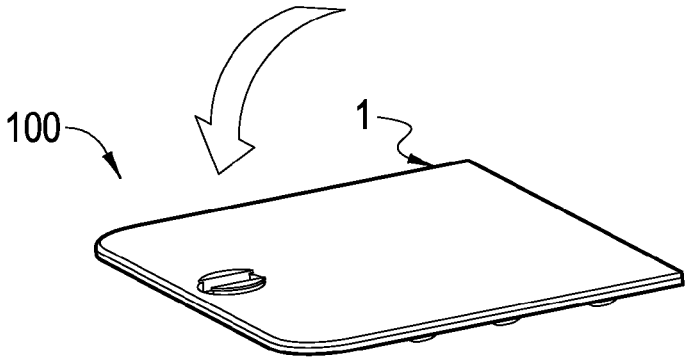

Referring to FIG. 3A to FIG. 3C, views of a third embodiment of the inventive safe packaging container made to be folded are shown. In the inventive packaging container 100, an extended sheet 13 is formed from one end of the blister sheet 1, with a through-hole 31 disposed thereon. To fold the packaging container 100, the extended sheet 13 is folded onto the planar surface of the blister sheet 1 and fixed by locking a fixing element 3 disposed on the blister sheet 1 with the through-hole 31. The extended sheet 13 as folded makes the contents safe. In addition, auxiliary fixing elements 4 are optionally disposed for strengthening the connection of the folded blister sheet 1.

Figure 4A:
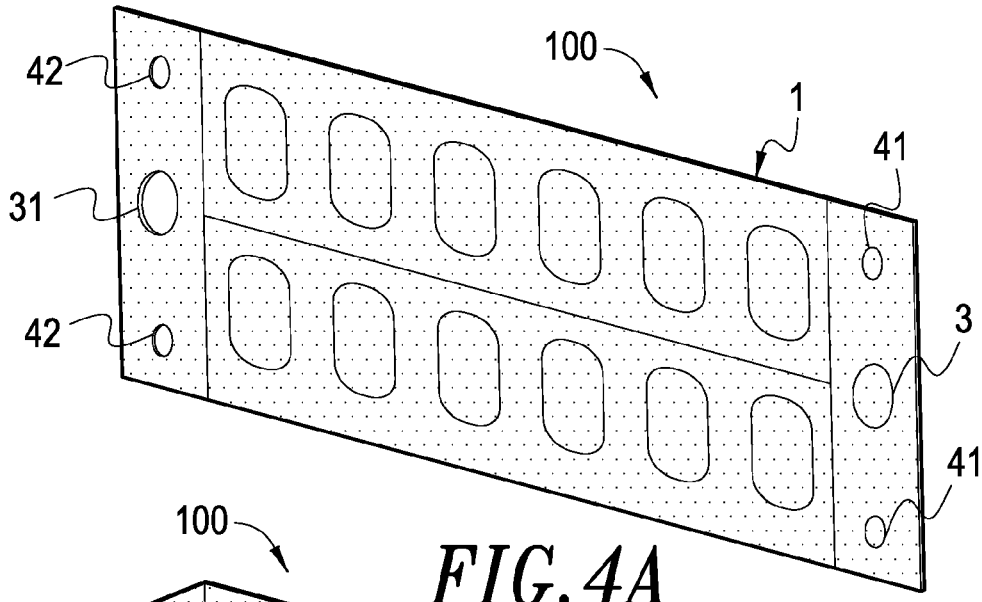
FIG. 4A to FIG. 4C. are views of a first embodiment of the inventive safe packaging container made to be rolled.
Figure 4B:
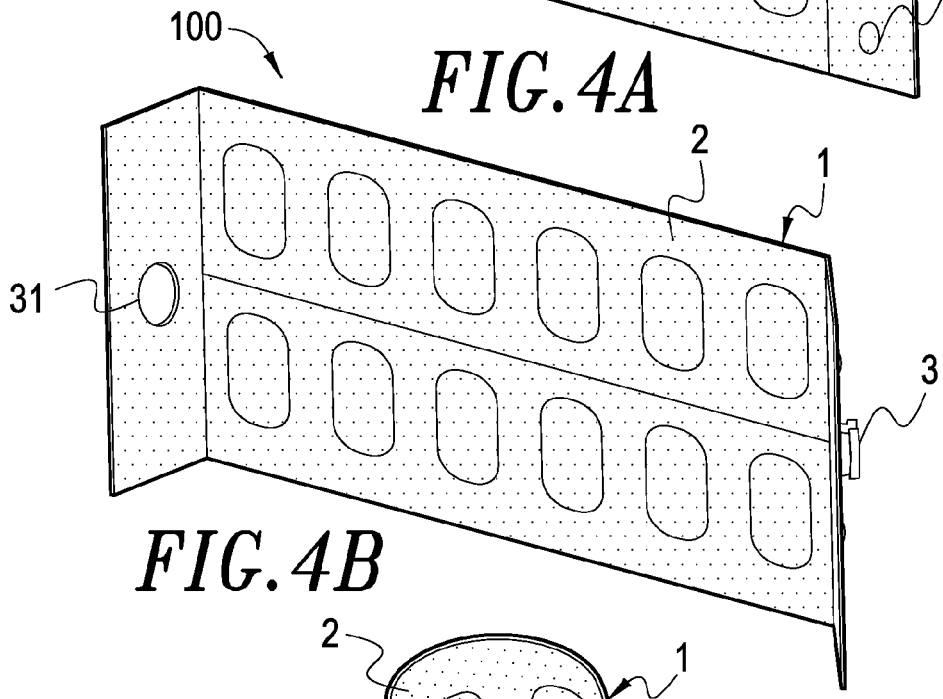
Figure 4C:
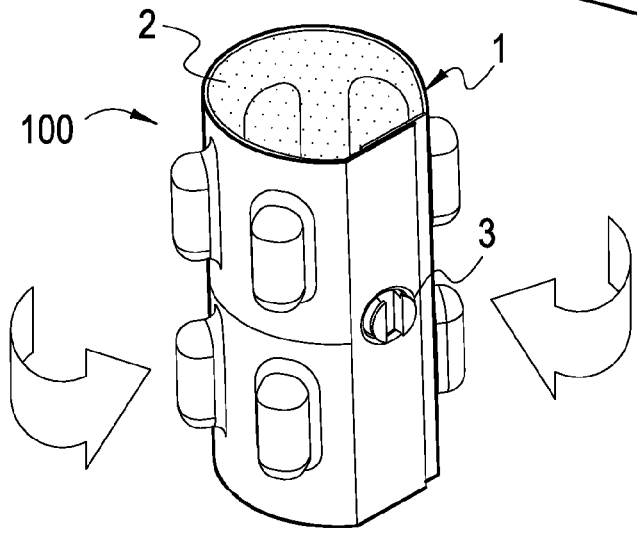

Referring to FIG. 4A to FIG. 4C, views of a first embodiment of the inventive safe packaging container made to be rolled are shown. In the inventive packaging container 100, a fixing element 3 and a button 41 are disposed at one end of the blister sheet 1 while a through-hole 31 and a concave hole 42 are disposed at the other end of the blister sheet 1. To roll the packaging container 100, the blister sheet 1 is directly bent, with the planar surface thereof facing inwards, and the fixing element 3 disposed at one end of the blister sheet 1 perforates through and locks with the through-hole 31 disposed at the other end of the blister sheet 1 and the button 41 is embedded in the concave hole 42. Thus, a rolled packaging container 100 is formed with the back film 2 being hidden as the inside thereof, so that the back film 2 is kept from being touched and breaking when the packaging container 100 is transported or moved.

Figures 5A, 5B:
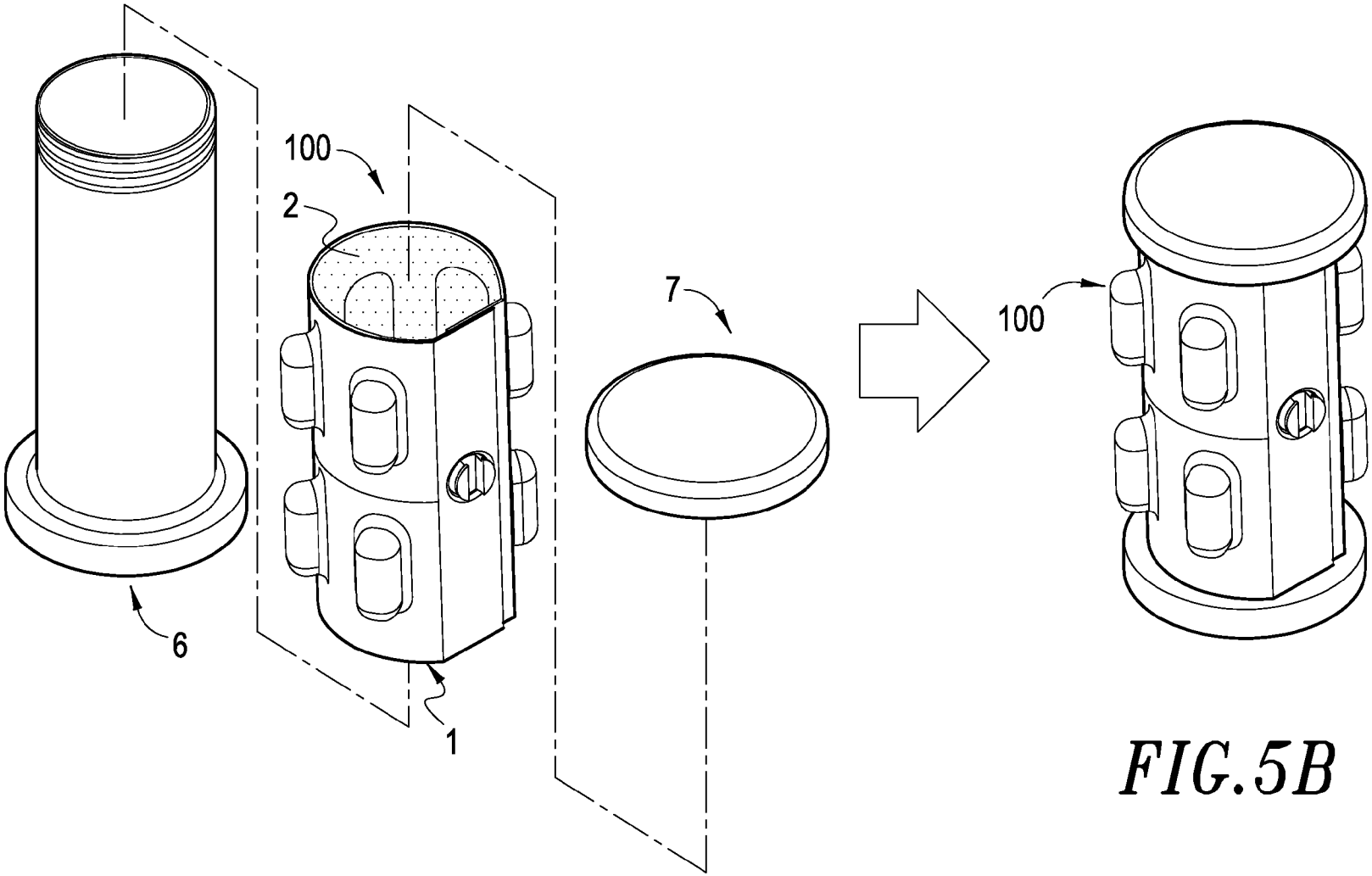
FIG. 5A to FIG. 5B. are views of a second embodiment of the inventive safe packaging container made to be rolled.

Referring to FIG. 5A to FIG. 5B, views of a second embodiment of the inventive safe packaging container made to be rolled are shown. A rolled packaging container 100 is fixed around a cylindrical base 6 and is capped by a screwing cap 7. The cylindrical base 6 penetrates the space defined by the bent blister sheet 1 and is connected with the screwing cap 7, so that the rolled packaging container 100 is confined between the cylindrical base 6 and the screwing cap 7. Thus, the back film 2 can be protected more completely.

Figures 6A, 6B:
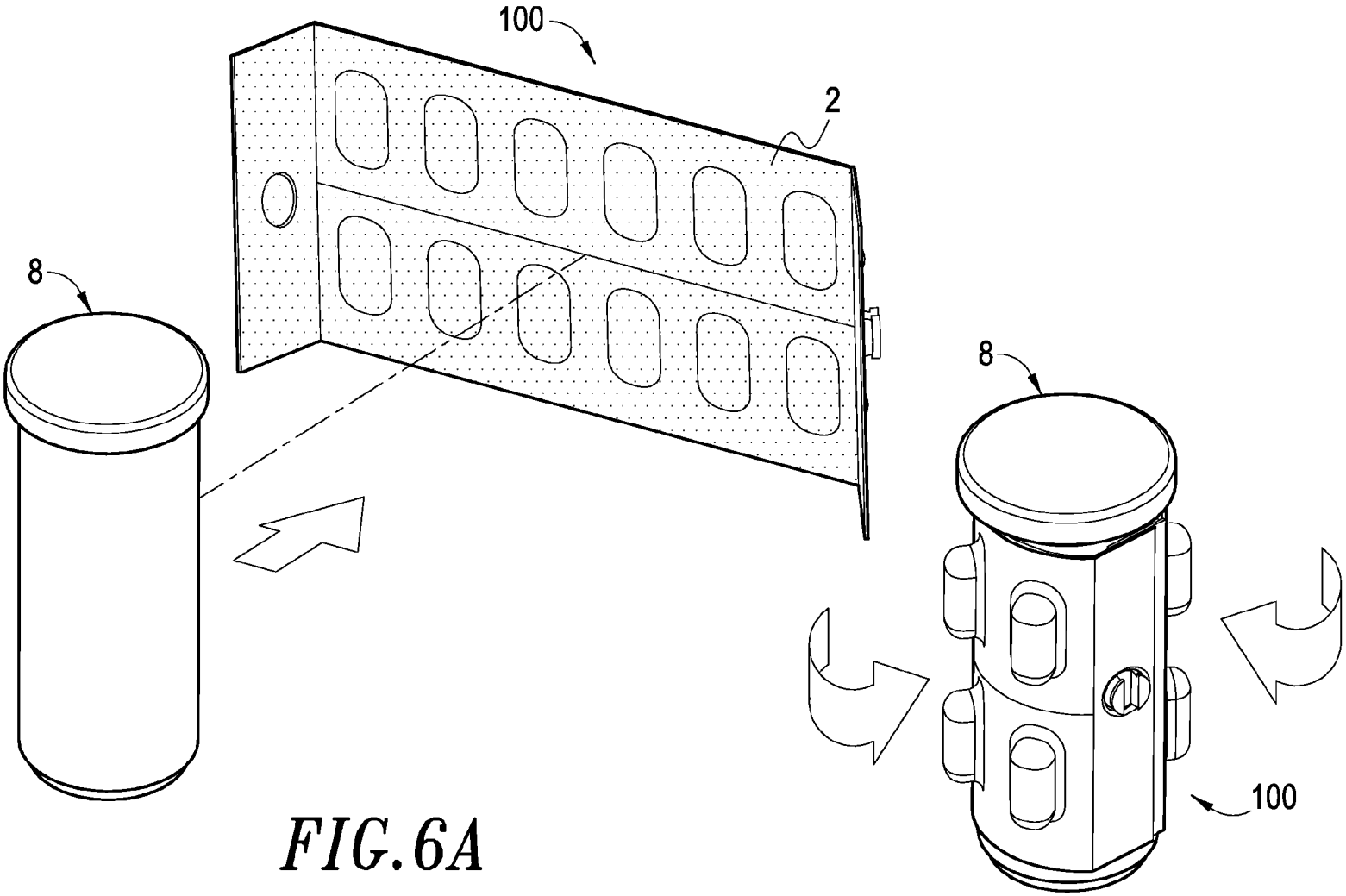
FIG. 6A to FIG. 6B are views of a third embodiment of the inventive safe packaging container made to be rolled

Referring to FIG. 6A to FIG. 6B, views of a third embodiment of the inventive safe packaging container made to be rolled are shown. A packaging container 100 is directly rolled about a cylindrical body 8, so that the back film 2 is close to the surface of the cylindrical body 8 for further protection. Thus, a greater amount and a variety of contents can be carried without additional protective package and, therefore, the cost of production can be decreased.

Figure 7A:
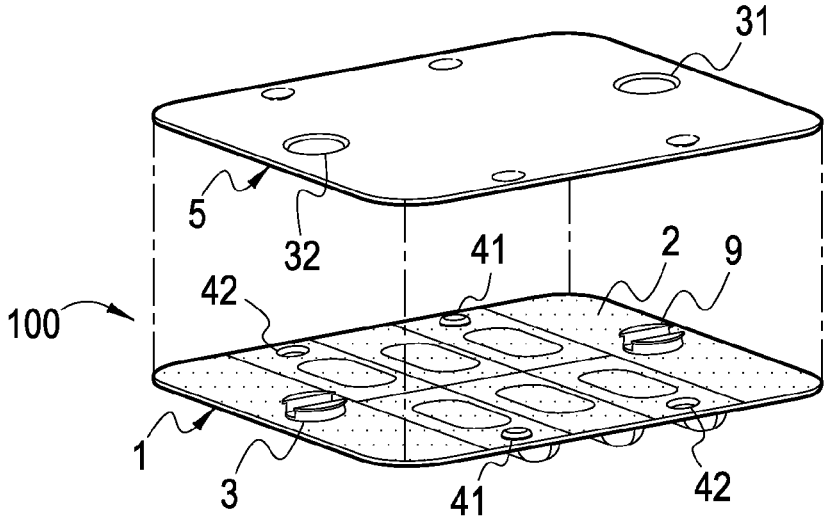
FIG. 7A to FIG. 7C are views of a first embodiment of the inventive safe packaging container made to be covered.
Figure 7B:
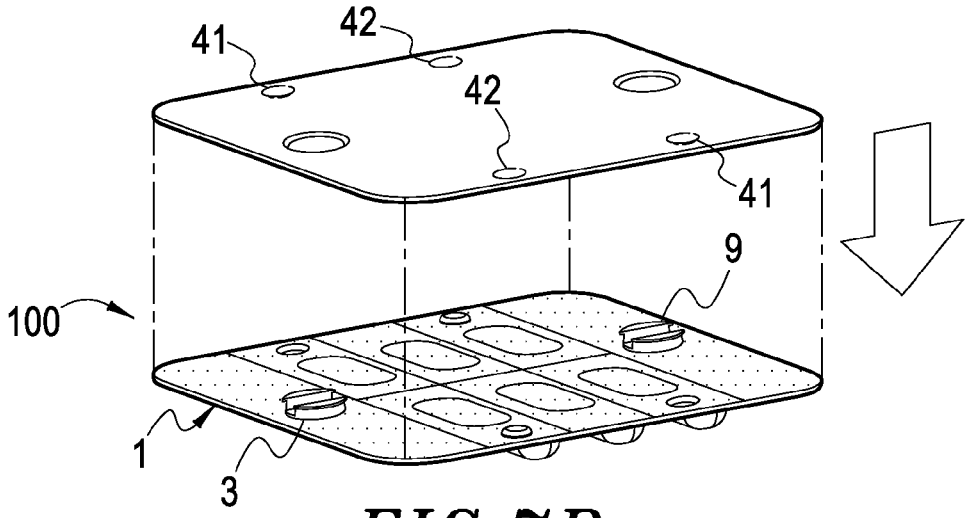
Figure 7C:
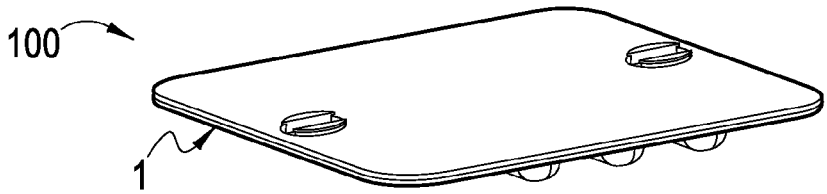

Referring to FIG. 7A to FIG. 7C, views of a first embodiment of the inventive safe packaging container made to be covered are shown. When the blister sheet 1 and the back film 2 are bound together, an overlaying cover 5 may be disposed so that the overlaying cover 5 may directly cover the planar surface of the blister sheet 1. A through-hole 31 and a through-hole 32 are disposed on the overlaying cover 5 and a fixing element 3 and a fixing element 9 are disposed on blister sheet 1, so that the fixing element 3 and the fixing element 9 perforate through and lock with the through-hole 31 and the through-hole 32, respectively. Moreover, a plurality of buttons 41 and a plurality of concave holes 42 are disposed at the edges of the blister sheet 1 and the overlaying cover 5, for strengthening the connection. Thus, the contents in the packaging container 100 are made safe.

Figure 8A:
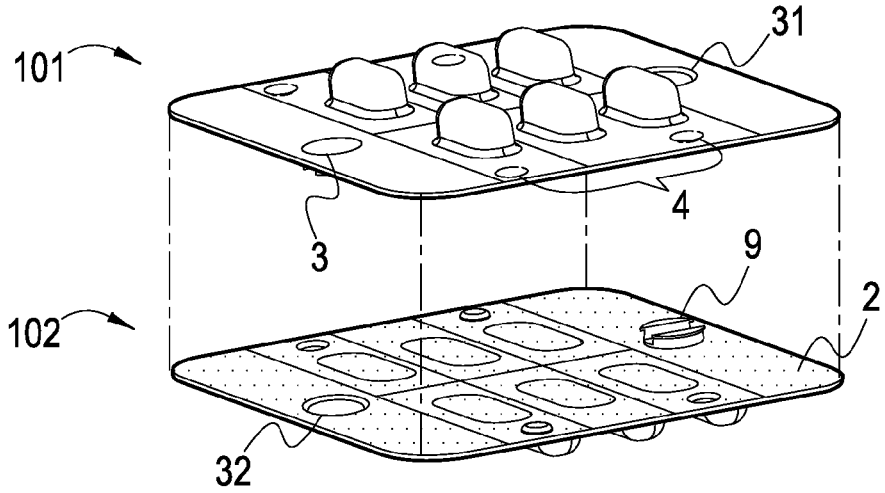
FIG. 8A to FIG. 8C are views of a second embodiment of the inventive safe packaging container made to be covered.
Figure 8B:
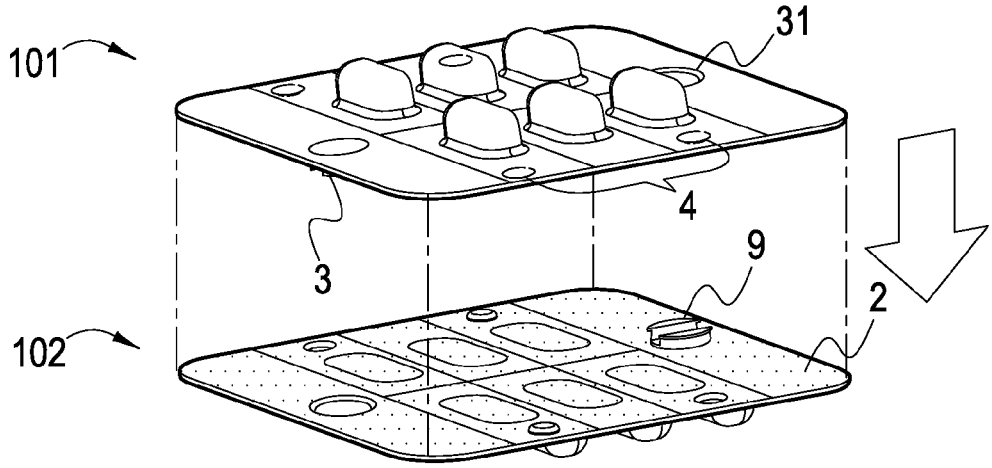
Figure 8C:
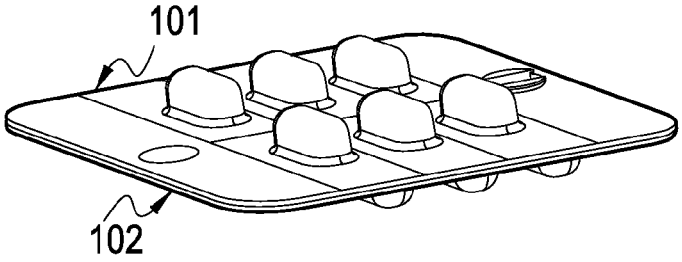
Figure 9A:
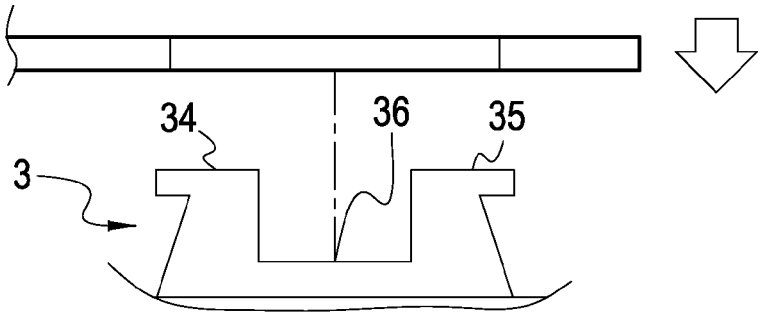
FIG. 9A to FIG. 9D are schematic diagrams of operation of the fixing element of the inventive safe packaging container.
Figure 9B:
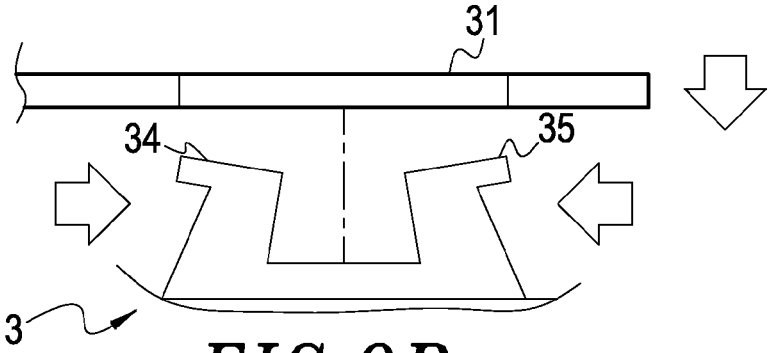
Figure 9C:
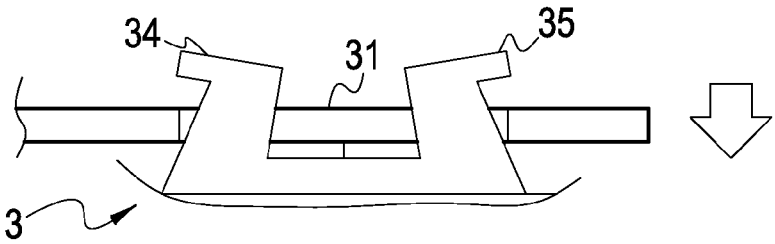
Figure 9D:
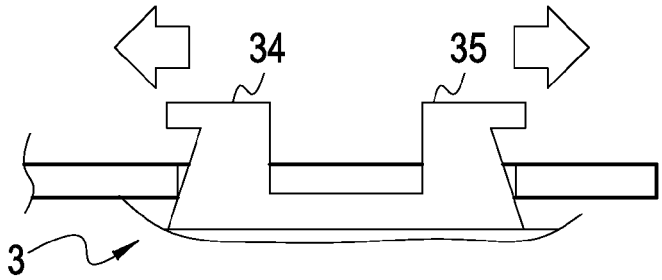

Referring to FIG. 8A to FIG. 8C, views of a second embodiment of the inventive safe packaging container made to be covered are shown. Two packaging containers 101 and 102 are fixed together, each being bound to the back film 2 surface of the other. On the packaging container 101, a fixing element 3, a through-hole 31 and a button and a concave hole of auxiliary fixing elements 4 are disposed, and on the packaging container 102, a fixing element 9, a through-hole 32 and an a button and a concave hole of auxiliary fixing elements 4 are disposed, so that the fixing elements, the through-holes and the auxiliary fixing elements can lock correspondingly and the contents is protected. This way of connection, in particular, is useful if the packaging container cannot be folded evenly.

Referring to FIG. 9A to FIG. 9D, schematic diagrams of operation of the fixing element of the inventive safe packaging container are shown. According to the present invention, the fixing element 3 is designed to lock in clipping mode. The fixing element 3 has a preformed groove 36 disposed in the middle thereof, and latches 34, 35 respectively disposed to the ends of the preformed groove 36. As the fixing element 3 is connected to a through-hole 31, the latches 34, 35 are depressed so as to displace to tilt towards the preformed groove 36. As the fixing element 3 perforates through the through-hole 31, the latches 34, 35 are loosened and lock with the through-hole 31. The fixing element 3 may also be designed to lock in pressing or screwing modes. Depending on the practical requirement for the connection strength, the quantity of disposed fixing elements may be changed.

Figure 10A:
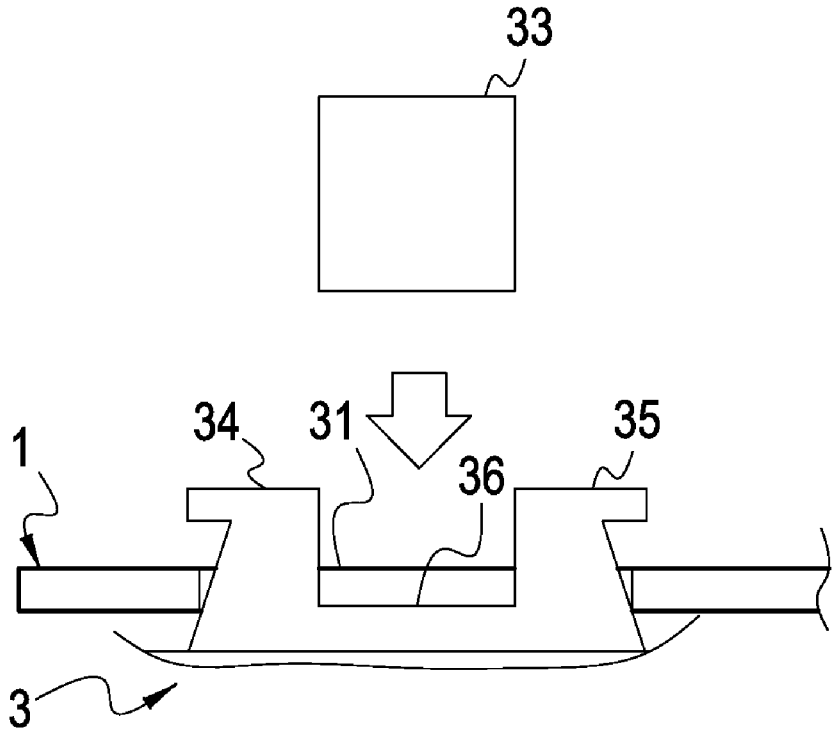
FIG. 10A to FIG. 10B are schematic diagrams of the operation of the fixing latch member of the inventive safe packaging container.
Figure 10B:
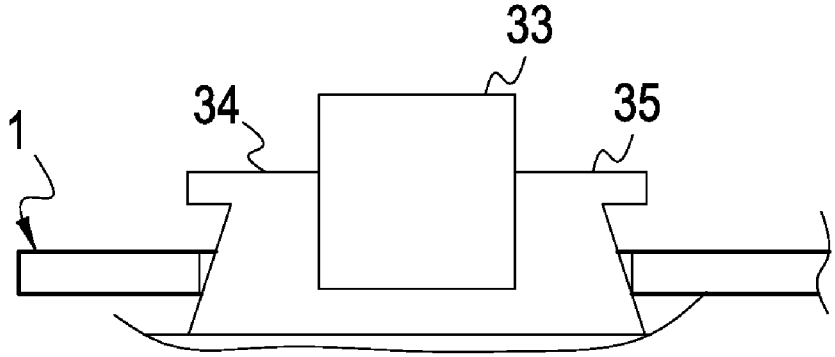

Referring to FIG. 10A to FIG. 10B, schematic diagrams of the operation of the fixing latch member of the inventive safe packaging container are shown. In order to further lock the fixing element 3, a fixing latch member 33 is placed in the preformed groove 36 after the latches 34, 35 lock with the through-hole 31, to seal up the space of the preformed groove

36 so that the latches 34, 35 cannot tilt towards the preformed groove 36. Such a double-locking procedure makes the blister sheet 1 not easy to open, reducing the danger of children's ingestion greatly. The fixing latch member 33 may be combined into the packaging container 100 or used as an independent member.

The inventive safe packaging container made to be folded is also applicable as a re-useable drug box. For this purpose, a drug box has a crease disposed in the middle thereof, and has fixing elements and through-holes can be disposed at the ends thereof. The drug box can be folded about the crease so as to be closed, and fixed by the fixing elements and the through-holes. Thus, the drug box is not easy to open and the danger of children's ingestion can be reduced.

The safe packaging container provided by the present invention, as compared with conventional ones, has the following advantages.

1. It has an improved blister type to solve the disadvantage of conventional blister-type package, which is easy to open, so as to promote the package safety.

2. It is made to be folded or rolled so as to have an effectively reduced volume and thereby has promoted safety and convenience when being transported.

3. It has wide applications, low cost, simple fabrication and ease of use.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A safe packaging container comprising:

a blister sheet having a plurality of recesses concavely disposed thereon for loading contents;

a back film, bounded on the planar surface of the blister sheet so as to cover the contents loaded in the recesses;

an overlaying cover coupled to a first edge of the blister sheet and structured to fold over the blister sheet to cover the bounded back film, the overlaying cover having a throughhole defined therein;

a fixing element disposed on a second edge of the blister sheet opposing the first edge, the fixing element structured to releasably couple to the through-hole to secure the overlaying cover to the blister sheet, wherein the overlaying cover hides the back film under the condition that the overlaying cover is secured to the blister sheet by the fixing element, and wherein the fixing element comprises a groove between latches, wherein an outer perimeter of the latches in a resting position is larger than an inner diameter of the throughhole, the latches being structured to flex from the resting position toward the groove to an inward flexed position so as to fit through the through-hole, the latches also being structured to release back to the resting position once placed through the through-hole, the latches securing the overlaying cover to the blister sheet in the resting position; and a fixing latch member that is structured to be placed within the groove of the fixing element after the fixing element has secured the overlaying cover to the blister sheet, the fixing latch member being configured to prevent the latches from flexing inward.

* * * * *